US008347676B2

(12) United States Patent
de Andrade et al.

(10) Patent No.: US 8,347,676 B2
(45) Date of Patent: Jan. 8, 2013

(54) CONSTRUCTIVE IMPROVEMENT TO AN ANTI-THEFT LOCK DEVICE APPLIED TO AUTOMOBILE TRUNKS

(75) Inventors: Homero de Andrade, Sao Paulo (BR); Antonio de Oliveria Silva, Sao Paulo (BR); Jose de Jesus Pin, Sao Paulo (BR)

(73) Assignee: Valeo Sistemas Automotivos Ltda. (BR)

( * ) Notice: Subject to any disclaimer, the term of this patent is extended or adjusted under 35 U.S.C. 154(b) by 506 days.

(21) Appl. No.: 11/720,418

(22) PCT Filed: Nov. 30, 2005

(86) PCT No.: PCT/BR2005/000248

§ 371 (c)(1),
(2), (4) Date: Nov. 24, 2008

(87) PCT Pub. No.: WO2006/058401

PCT Pub. Date: Jun. 8, 2006

(65) Prior Publication Data

US 2009/0102625 A1 Apr. 23, 2009

(30) Foreign Application Priority Data

Nov. 30, 2004 (BR) ..... 8402906 U
May 31, 2005 (BR) ..... 8502212 U

(51) Int. Cl.
*E05B 9/08* (2006.01)

(52) U.S. Cl. ..... 70/370; 70/451; 70/466

(58) Field of Classification Search ..... 70/370, 70/371, 448, 451, 466, 368, 417, 449, 452; 403/21, 22

See application file for complete search history.

(56) References Cited

U.S. PATENT DOCUMENTS 4,381,656 A * 5/1983 Hayakawa ..... 70/451
5,548,981 A * 8/1996 Kirk ..... 70/58
5,551,268 A * 9/1996 Carnes et al. ..... 70/370
5,636,540 A * 6/1997 Myers ..... 70/370
5,768,923 A * 6/1998 Hill ..... 70/370

(Continued)

OTHER PUBLICATIONS

PCT/BR2005/000248, International Preliminary Report on Patentability dated Jun. 5, 2007.

*Primary Examiner* — Christopher Boswell
(74) *Attorney, Agent, or Firm* — Baker & McKenzie LLP

(57) ABSTRACT

A constructive improvement to an anti-theft lock device applied to automobile trunks, whose innovative solution implies a new anti-theft lock (1), applicable both to common trunk locks and to trunk locks having electric assembly elements, wherein said improvement provides greater productivity during the assembly of said item, in addition to providing greater reliability to the anti-theft safety system, and this is achieved thanks to a constructive concept wherein the anti-theft lock item (1) comprises a clench ring element (A), sealing joint (B), lock cylinder element (C) and fastening clinch element (D). The clench ring element (A) comprises a hollowed latch area (A1), an upper latch element (A2) and a lower latch element (A3), also having a relief lock (A4), in addition to structural grooves (A5). In turn, the fastening clinch element (D) has upper (D1) and lower (D2) latch ends, having an inflexion segment (D3) in its middle section, and both these elements are fitted into the lock cylinder element (C). Once assembled, the anti-theft lock item (1) prevents the access of tools (4) to the bracing element (F), thanks to the formation of a height barrier (H1), also generating a width (H2) which eliminates assembly gaps.

32 Claims, 9 Drawing Sheets

U.S. PATENT DOCUMENTS 5,931,035 A * 8/1999 Bolton ..... 70/367
6,079,241 A * 6/2000 Burleigh et al. ..... 70/370
6,568,229 B1 * 5/2003 Heinrich ..... 70/370
6,901,638 B2 * 6/2005 Itou et al. ..... 70/370
7,444,845 B2 * 11/2008 Kargilis et al. ..... 70/370
2008/0087061 A1 * 4/2008 Kargilis et al. ..... 70/370

* cited by examiner

CONSTRUCTIVE IMPROVEMENT TO AN ANTI-THEFT LOCK DEVICE APPLIED TO AUTOMOBILE TRUNKS

This present utility model patent application addresses a constructive improvement to an anti-theft lock device applied to automobile trunks providing pioneering advantages in relation to the assembly system and lock protection applied to automobile trunks, including locks with coupled electrical devices, resulting in significant productivity gain during assembly of the parts with the trunk hood, when analyzing advantages from the industrialization viewpoint. It also provides significant gains in terms of safety against vandalism and or theft of the vehicle.

The significant gain in productivity enable automobile sector companies, particularly assembly plants, to obtain reduced fixed assembly costs for the trunk hood lock.

Further, with the system of assembling the now improved lock, assembly quality is guaranteed, minimizing out-of-spec problems, both in assembly and in the working of said lock during its useful life, having reduced corrective maintenance for this vehicle item.

From the point of view of safety against theft, the solution now claimed adds value directly to the automotive vehicle by increasing difficulty in accessing the trunk of the vehicle, thus providing greater reliability against theft and untoward action.

Bearing in mind the increasing demand for vehicles that offer maximized security to the end consumer, the improvement now claimed fulfills this need, thanks to the optimization of the product now claimed.

BACKGROUND ART

From this angle, comparing the improved solution with simple trunk-lock type models that are already known to the state of the art, it is clear that the latter are deficient in their constructive and functional concept. Assembly of such trunk locks is lacking in productivity, since the assembler has no physical or visual access which is required for adequate assembly procedure of trunk locks.

This inferior work condition generates a loss in productivity, which comprises ambitious production targets.

Moreover, in view of the limited number of potential assemblies of the lock-type items, such items have out-of-spec rates higher than the ranges defined by the industry's quality control sectors.

Another well-known fact is that an analysis of the value of the trunk lock item, from the point of view of safety against theft, reveals their vulnerability against the action of offenders. This is aggravated by the fact that it is easy to break the lock by releasing it from its latch on the metallic structure of the trunk.

Still within the scope of perceived safety, the solutions known to the state of the art can be violated, by totally withdrawing the body from the trunk door, or by the offender creating an opening in the trunk metalwork, precisely in the latch area of the lock-type item. A screwdriver type tool, for example, can easily be forced into such opening, breaking open the bracing item, the function of which is to provide the locking or release of the trunk hood.

Having stated this, a more in-depth analysis of the assembly and operation conditions of trunk lock-type items leads one to the conclusion that the design is lacking in terms of reliability. However, the new equipment mentioned herein achieves the functional design targets. Having analyzed the negative aspects mentioned herein, understandably there is room for development of products of the same nature, but with greater versatility in the assembly process, resulting in improved productivity, with quality and reliability, from the point of view of effectiveness with regards preventing theft offenders.

SUMMARY OF THE INVENTION

In view of such a challenge, the applicant developed innovative solutions in trunk locks, more specifically applied in common trunk locks or trunks locks with electric components, the constructive concept of which provides advantages mentioned herein in relation to the state of the art. The assembly system of said improved item discards the lock pin, facilitating its assembly on the trunk hood, minimizing the assembler's physical and visual action, thus guaranteeing assembly integrity and avoiding out-of-spec assembly problems of said item.

Moreover, the constructive concept applied to the now improved trunk lock provides for the locking of the fastening clinch element, in conjunction with a clench ring element, designed to receive a perfect-fitting latch from the fastening clinch element. It also contributes value by adding a function which resides in providing protection for the bracing element, since it avoids access to this element by any kind of tool used in violations against the trunk.

Within this same constructive concept now claimed, the applicant also presents a constructive variation applicable both to common trunk locks and to trunk locks with electric components, conferring the new product greater flexibility in the assembly of different assembly specifications.

In short, for current levels of competitiveness in the automobile industry, it is essential to strive for improvements in productivity with quality, reduce operating costs of assembly of trunk lock-type items, and also add unique reliability in the safety aspect against acts of violation. The solution now claimed meets the technical and commercial requirements previously set forth in this document, and also fully complies with the patentability requirements prescribed in the Industrial Property Law.

DESCRIPTION OF THE FIGURES

In complement to this present description, in order to obtain a better understanding of the features of the present utility model application, a set of drawings is attached to this description, exemplified by, but not limited to, the following.

DETAILED DESCRIPTION OF THE INVENTION

The following detailed description should be read and interpreted with reference to the drawings, where identical elements in different drawings are numbered equally, that is to say the same number is kept for an element used in two embodiments of the improvement. The drawings are highly diagrammatical, representing selected embodiments, but are not intended to limit the scope of the utility model, which is merely limited to that set forth in the set of claims.

Figure 1:
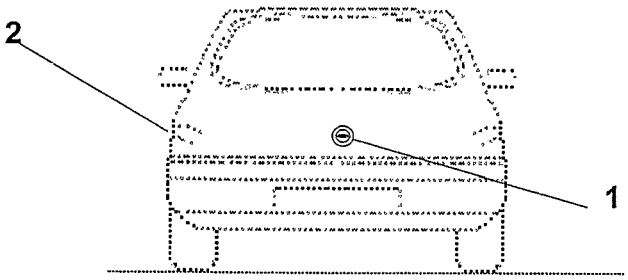
FIG. 1 depicts the area of application of the anti-theft trunk lock item now claimed on an automotive vehicle.
Figure 2:
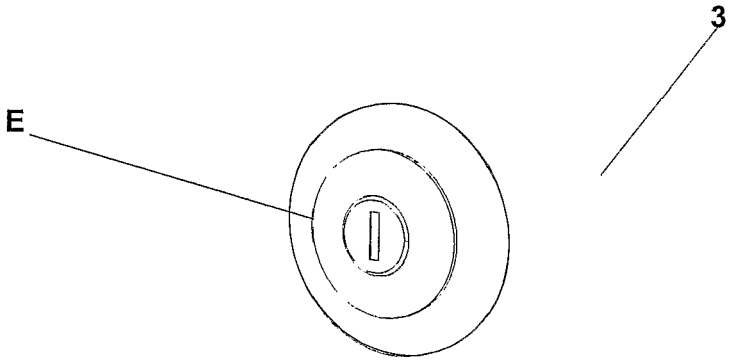
FIG. 2 depicts a perspective view of the outer section of the anti-theft trunk lock item now claimed, assembled on the automotive vehicle trunk hood.

With regards the illustrated drawings, in FIG. 1 the applicant understands that it is appropriate to present a representation of the anti-theft lock system (1), duly assembled on the automotive vehicle (2), and FIG. 2 is a graphical representation of the outer part (E) of the anti-theft lock-type product (1) on the trunk hood (3).

Figure 3:
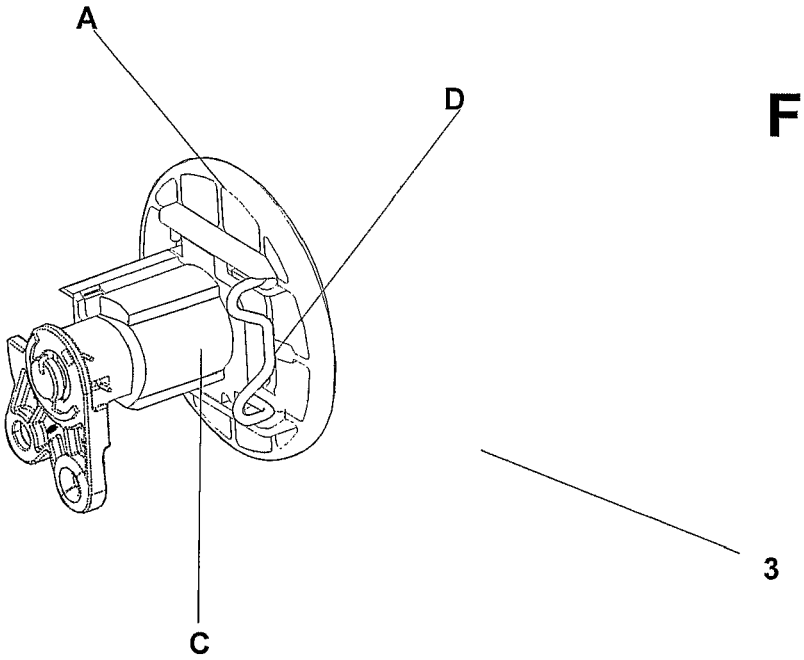
FIG. 3 depicts a perspective representation of the preferred embodiment for the anti-theft trunk lock item now claimed, more specifically of its inner section and assembled on the automotive vehicle trunk hood.

However, FIG. 3 effectively demonstrates the improvement in the anti-theft lock (1) now applied for, in a preferred embodiment, based on which improvements can be obtained in terms of assembly and reliability of the product that is the subject matter of the patent application.

Figure 4:
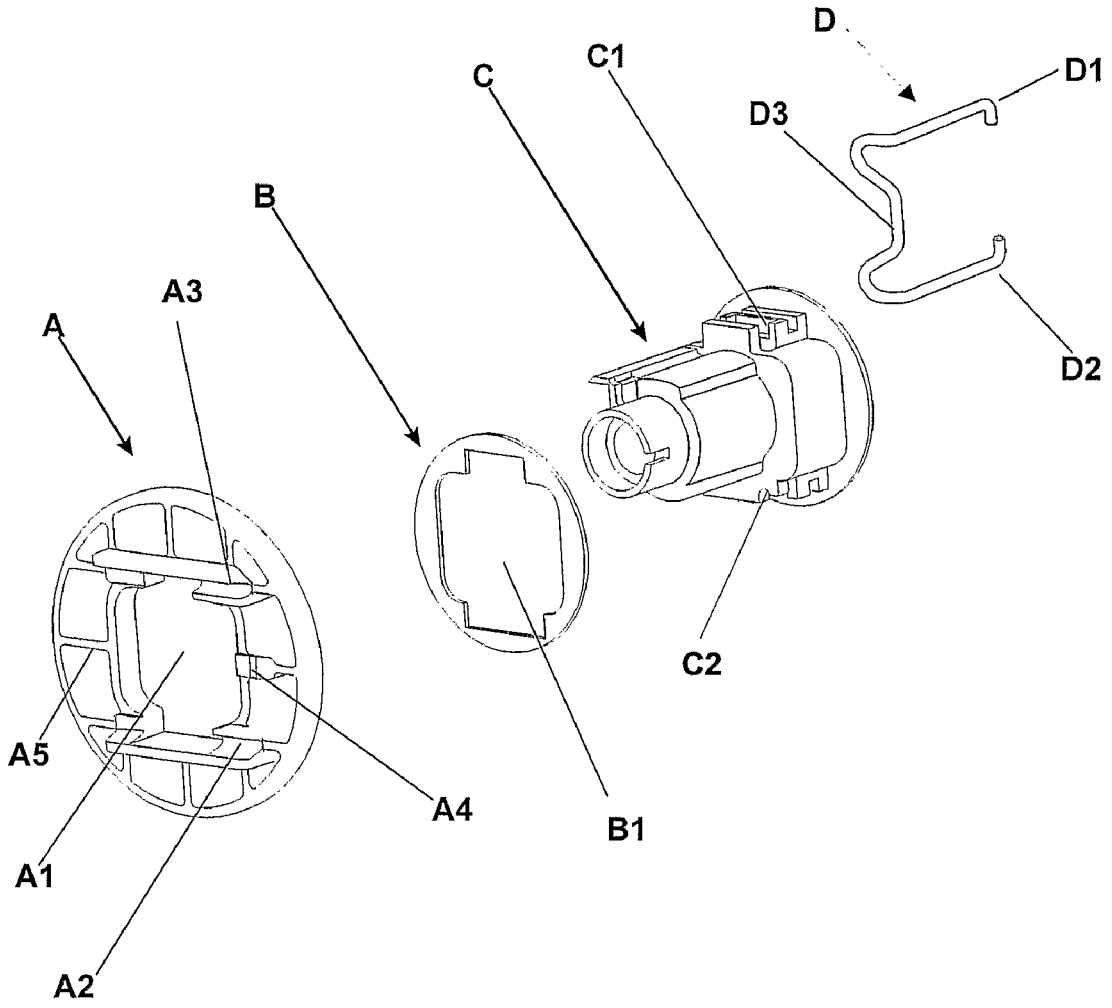
FIG. 4 depicts an exploded view of the preferred embodiment for the anti-theft trunk lock item now claimed.
Figure 5:
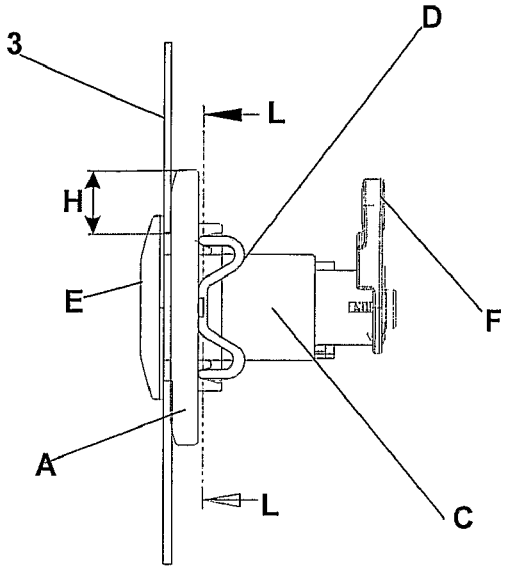
FIG. 5 depicts a side view of the preferred embodiment for the anti-theft trunk lock item now claimed, assembled on the automotive vehicle trunk hood.
Figure 6:
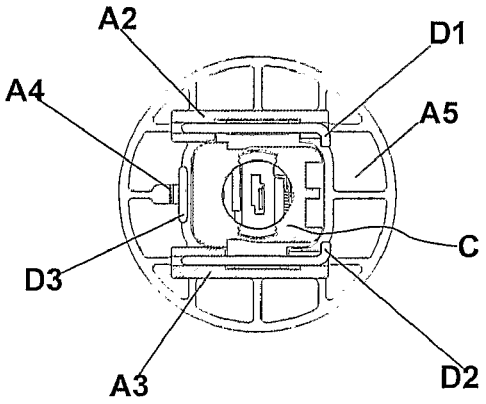
FIG. 6 depicts an "LL" cut view of the preferred embodiment for the anti-theft trunk lock item now claimed, assembled on the anti-theft trunk hood now claimed, assembled on the automotive vehicle trunk hood.
Figure 7:
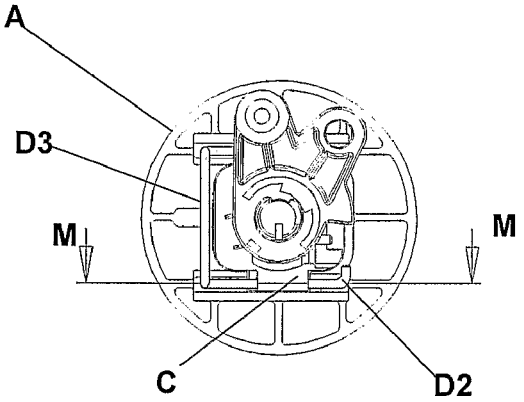
FIG. 7 depicts a representation of the front view of the inner section of the preferred embodiment for the anti-theft trunk lock item now claimed, assembled on the automotive vehicle trunk hood.
Figure 8:
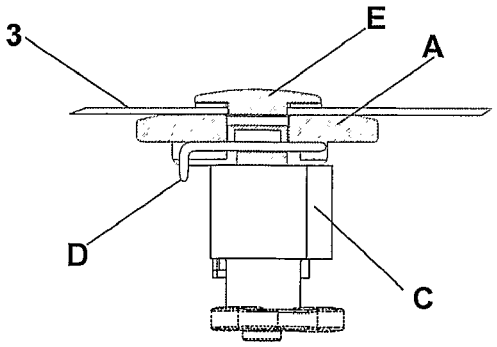
FIG. 8 depicts an "MM" cut view of the preferred embodiment for the anti-theft trunk lock item now claimed, assembled on the automotive vehicle trunk hood.

FIG. 4 is an exploded representation of the elements which form the trunk lock anti-theft product (1), and these are defined as clench ring element (A), sealing joint (B), lock cylinder element (C) and fastening clinch element (D).

There is also a so-called bracing element (F), which is directly benefited by the implementation of the improvement in the subject matter of the patent application. Said bracing element, however, has not undergone any form of modification and therefore will not be the subject matter of any claim in this application.

The constructive concept of the clench ring element (A) is based on a main body, in circumference form, which has a hollowed latch area (AI) in the middle section, the function of which is to provide for the latch at the front section of the lock cylinder element (C).

Furthermore, an upper (A2) and lower latch element (A3) is provided, the function of which is to provide for fastening of the upper (D1) and lower (D2) ends of the fastening clinch element (D).

Further in relation to the constructive concept of the clench ring element (A), a relief lock (A4) is provided, the function of which is to provide for locking of the fastening clinch element (D), when executing the final stage of assembly of the anti-theft lock (1).

For improved structure of the clench ring element body (A), it has structural grooves (A5) in one of its phases.

In turn, the outer profile of the sealing joint element (2) has a circumference form, the outer diameter of which is similar to the outer diameter of the clench ring element (A), also having a hallowed latch area (B1) in its middle section, the latter having a profile similar to that in the hollowed latch area (A1).

In turn, the lock cylinder element (C) is changed from the original project, introducing upper (C1) and lower attachment areas (C2), the function of which is to provide the latch of the upper (D1) and lower (D2) ends of the fastening clinch element (D), during the first stage of assembly of the anti-theft lock (1).

The fastening clinch element (D) is characterized by having upper (D1) and lower (D2) latch ends, having an inflexion segment (D3) in its middle section, the function of which is to provide locking for the fastening clinch (D), together with the relief lock (A4) of the clench ring element (A).

The interaction between the elements which make up the anti-theft lock product (1) may be fully understood in FIGS. 5, 6, 7 and 8 respectively.

Figure 9:
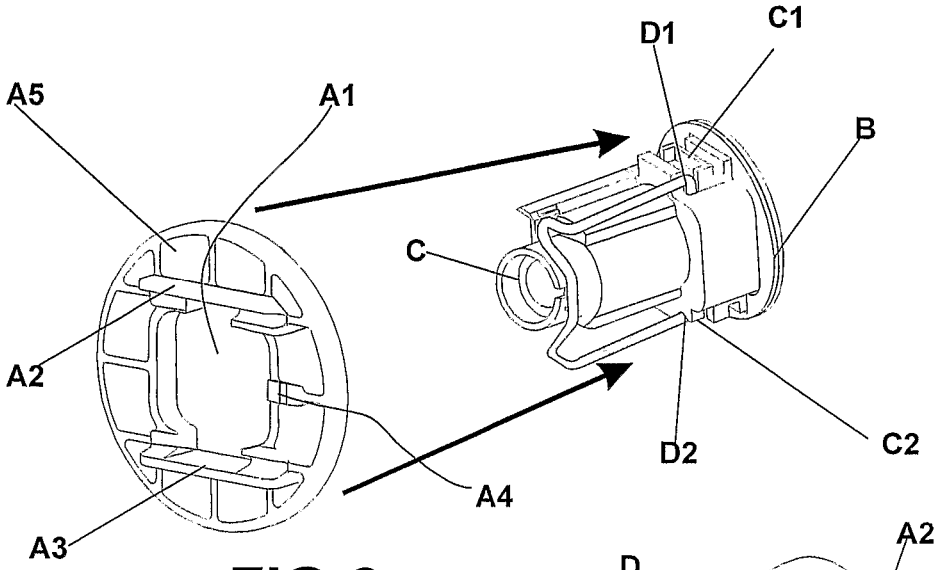
FIG. 9 depicts the first stage of assembly of the preferred embodiment for the anti-theft trunk lock item now claimed, on the automotive vehicle trunk hood.

The functional assembly concept of the anti-theft lock product (1) is defined by a first stage, represented in FIG. 9, where the clench ring (A) and sealing joint (B) elements, are previously assembled on the body of the lock cylinder element (C).

Figure 10:
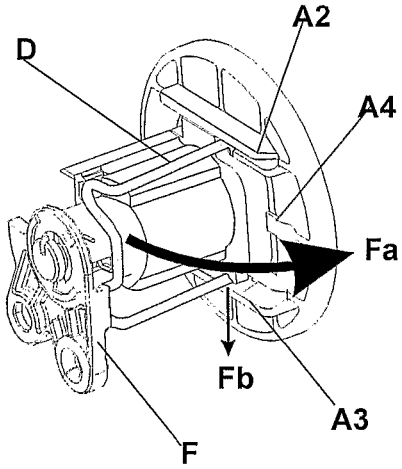
FIG. 10 depicts a representation of the second stage of assembly of the preferred embodiment for the anti-theft trunk lock item now claimed, on the automotive vehicle trunk hood.

Assembly of the fastening clinch element (D) is also carried out in this first stage, where the upper (D1) and lower (D2) ends are fitted on the upper (C1) and lower (C2) attachment areas. The result of this action can be seen in FIG. 10.

Having completed the first stage, the operator then starts the locking itself of the anti-theft lock product (1), by applying a radial dislocation force (fa), directly in the middle section, namely, the inflexion segment (D3) of the fastening clinch element (D), forcing the upper (D1) and lower (D2) ends to move (Fb) from the houses represented by the upper attachment areas (C1) and lower attachment area (C2) of the lock cylinder element (C).

Figure 11:
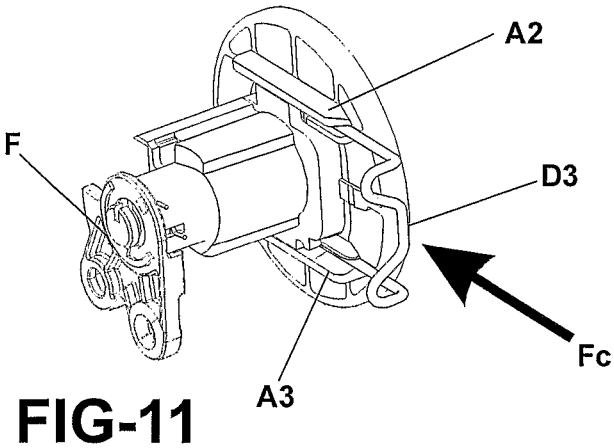
FIG. 11 depicts the third stage of assembly of the preferred embodiment for the anti-theft trunk lock item now claimed, on the automotive vehicle trunk hood.

The radial dislocation of the fastening clinch element (D) displaces until the upper (D1) and lower (D2) form an angle of 90 degrees in relation to the clench ring element (A), and the effective result of this action is represented in FIG. 11.

Figure 12:
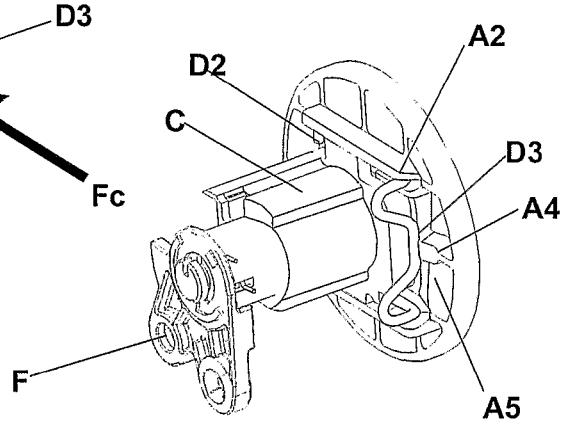
FIG. 12 depicts a representation of the fourth stage of assembly of the preferred embodiment for the anti-theft trunk lock item now claimed, on the automotive vehicle trunk hood.

In the third stage of assembly, the operator applies a linear dislocation force (Fc), also directly on the middle section, namely the inflexion segment (D3) of the fastening clinch element (D), forcing the upper (D1) and lower (D2) ends to move over the upper latch element (A2) and lower latch element (A3) respectively. Dislocation comes to an end when there is interference of the inflexion segment (D3) on the relief lock (A4), provided for in the clench ring element (A), causing effective locking of the anti-theft lock product (1). This is clearly seen in FIG. 12.

Figure 13:
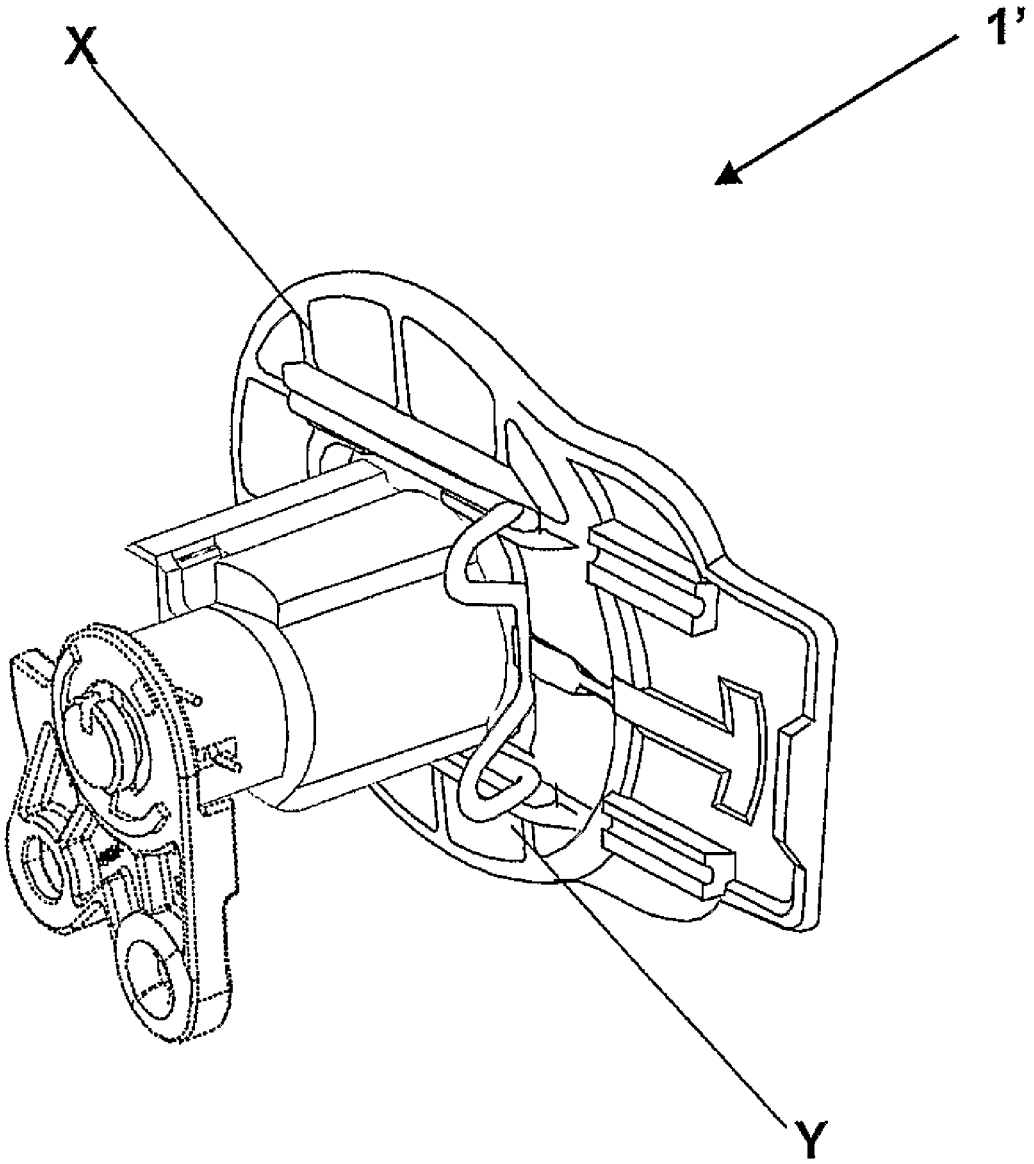
FIG. 13 depicts a perspective of the first variation to the preferred embodiment for the anti-theft trunk lock item now claimed, more specifically of its internal section and assembled on the automotive vehicle trunk hood.
Figure 15:
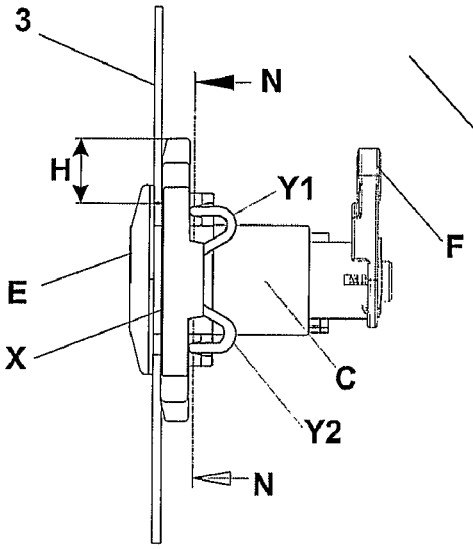
FIG. 15 depicts a side view of a first variation to the preferred embodiment for the anti-theft trunk lock item now claimed, assembled on the automotive vehicle trunk hood.
Figure 16:
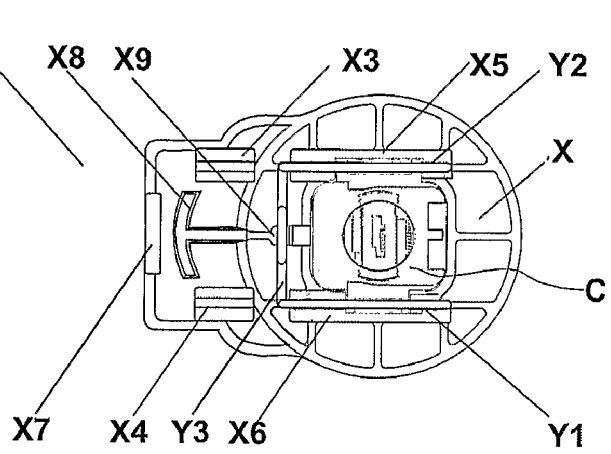
FIG. 16 depicts an "NN" cut view of a first variation to the preferred embodiment for the anti-theft trunk lock item now claimed, assembled on the automotive vehicle trunk hood.
Figure 17:
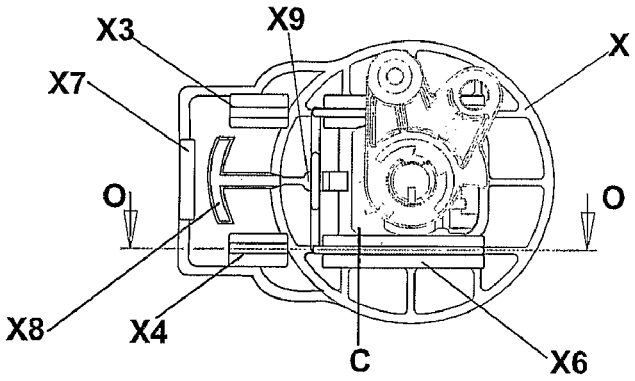
FIG. 17 depicts a front view of the internal section of a first variation to the preferred embodiment for the anti-theft trunk lock item now claimed, assembled on the automotive vehicle trunk hood.
Figure 18:
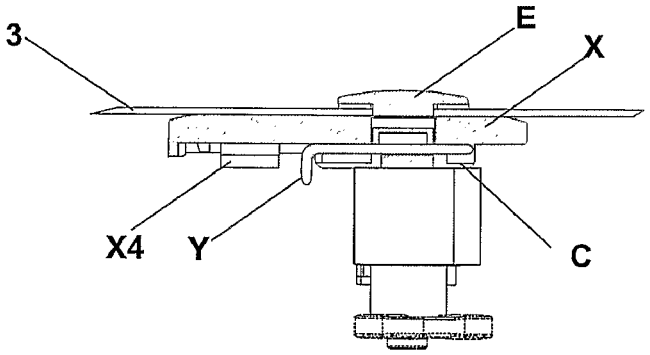
FIG. 18 depicts an "OO" cut view of a first variation to the preferred embodiment for the anti-theft trunk lock item now claimed, assembled on the automotive vehicle trunk hood.

In complement to the preferred embodiment widely described in this document, the applicant presents a first variation thereto in terms of constructive and functional concepts, characterized mainly by the fact that the assembly can be applied to any kind of trunk lock, such as trunk locks with electric components assembled in the body of the lock cylinder element (C). This can be seen in FIGS. 13, 15 and 17.

Figure 14:
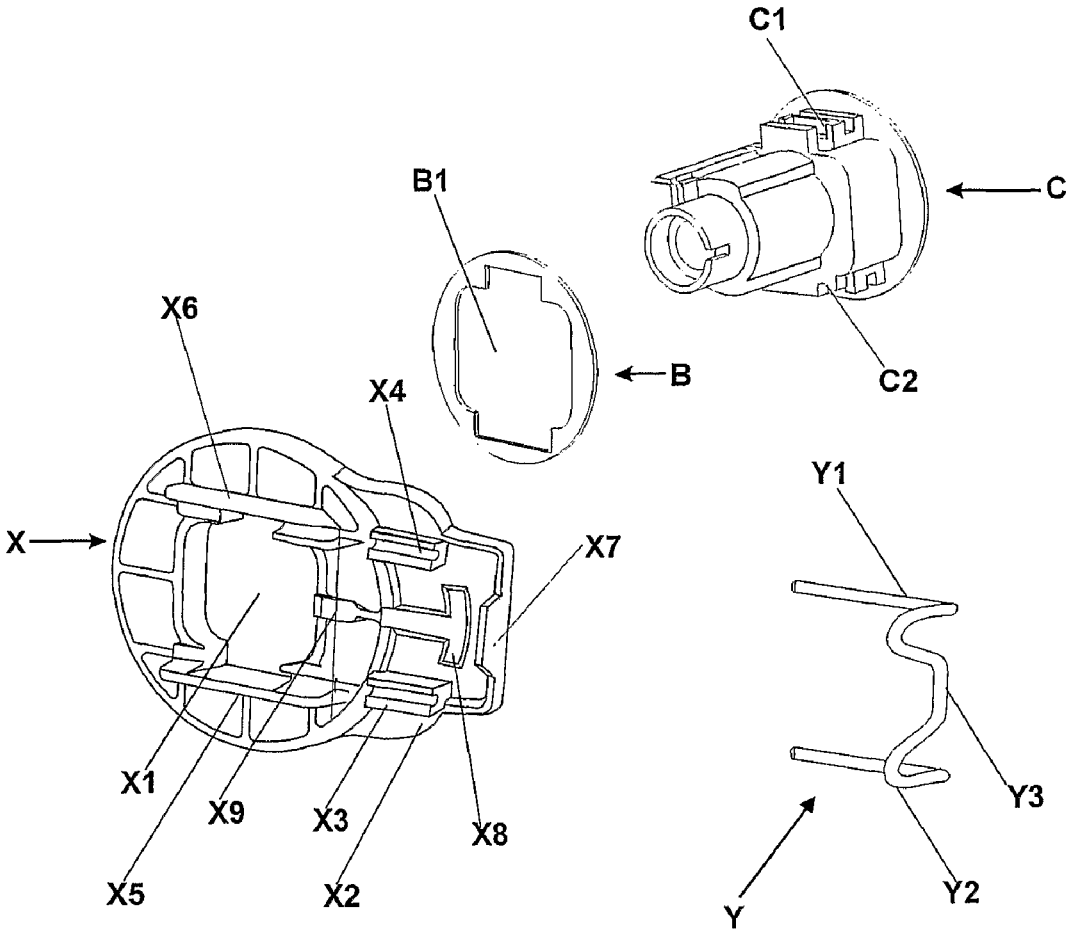
FIG. 14 depicts an exploded perspective of a first variation to the preferred embodiment for the anti-theft trunk lock item now claimed.

In this context, FIG. 14 is a representation in exploded view of the elements which make up the anti-theft lock product (1'), said elements being defined as follows: universal clench ring element (X), sealing joint (B), lock cylinder element (C) and fastening clinch element (Y).

The constructive concept of the universal clench ring element (X) is based on a main body, in circumference form, which has a hollowed latch area (X1) in the middle section, the function of which is to provide latch on the front section of the lock cylinder element (C).

The left-hand adjoining section of the universal clench ring element (X) has a support area (X2) which can be defined as a side extension of the body of the universal clench ring element (X), the main function of which is to support the assembly elements and to limit the fastening clinch element (Y).

With regards assembly of the elements, a pair of latch structures is defined, having alpha-numeric references (X3) and X4) respectively, and placed parallel, these having the first function of providing a latch by pressure of rods (Y1) and (Y2) of the fastening clinch element (Y), and a second function resides in providing a lock movement guide of this same fastening clinch element (Y). It is important to highlight that the rods (Y1) and (Y2), are linear, having rounded ends to allow their free movement through the guides formed by two pairs of latch structures (X3), (X4), (X5) and (X6) respectively.

In complement to said movement guide function, there is a second pair of latch structures, having alpha-numerical references (X5) and (X6), respectively, being positioned parallel, but enveloping the core of the universal clench ring element (X), thus guaranteeing improved stability in locking movement.

The constructive concept of the universal clench ring element (X) also provides a wall (X7), the function of which is to provide limit of movement of the fastening clinch element (Y), the latter associated to the high relief area (X8) creating a latch for the inflexion segment (Y3) having the function of preventing the free movement of the fastening clinch element (Y) itself until the assembly procedure of the lock itself is carried out.

Finally, the universal clench ring element (X) also has a lowered lock (X9) in the high relief area (X8), the latter having the function of providing the locking of the fastening clinch element (Y), more specifically to provide locking by the inflexion segment latch (Y3) of this element, guaranteeing efficient assembly of the anti-theft lock product (1').

In turn, the sealing joint (B) is precisely the same element applied in the assembly of the preferred embodiment of the trunk lock, and the same occurs with the lock cylinder element (C).

The fastening clinch element is altered in relation to the fastening clinch element (D) defined in the preferred embodiment, giving origin to a second version called fastening clinch element (Y), characterized by having rods (Y1) and (Y2), the function of which is to provide guidance and movement for the lock of the anti-theft lock product (1').

The interaction of the component elements of the anti-theft lock product (1'), may be fully understood in FIGS. 15, 16, 17 and 18 respectively.

Figure 19:
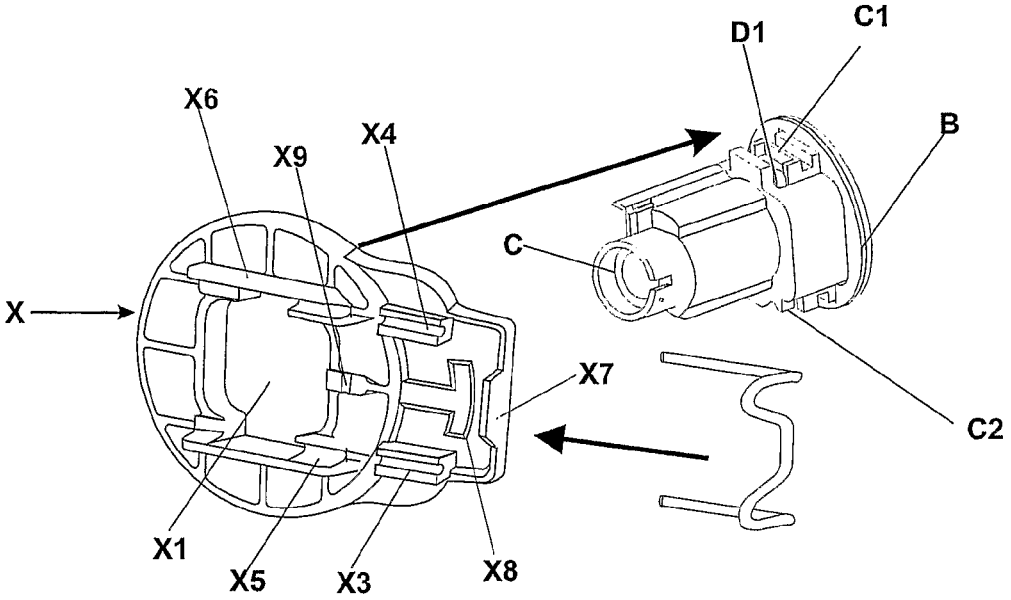
FIG. 19 depicts a side view of the first stage of assembly of a first variation to the preferred embodiment for the anti-theft trunk lock item now claimed.
Figure 20:
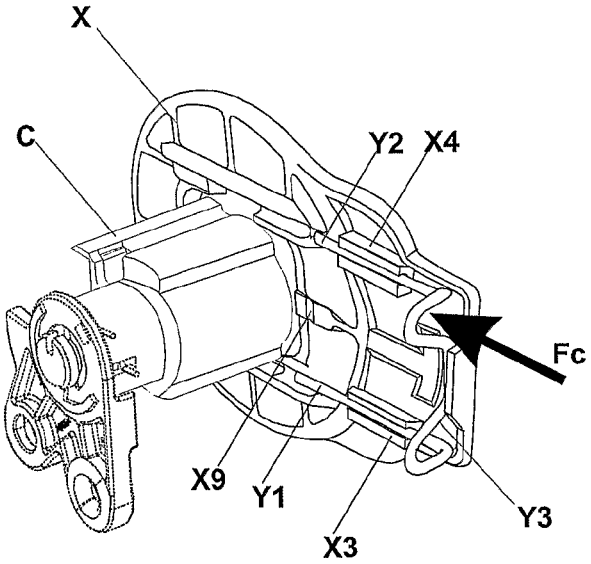
FIG. 20 depicts the second stage of assembly of a first variation to the preferred embodiment for the anti-theft trunk lock item now claimed, on the automotive vehicle trunk hood.
Figure 21:
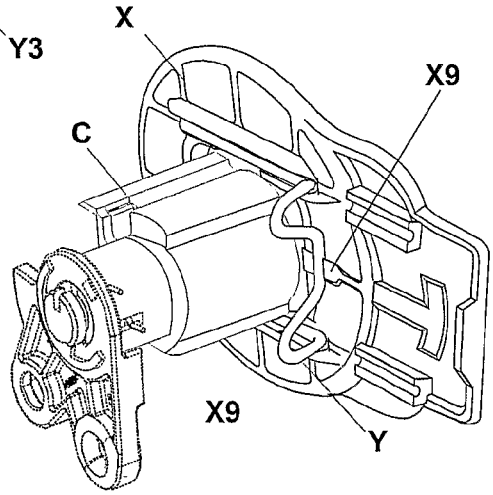
FIG. 21 depicts the third and final stage of assembly of a first variation to the preferred embodiment for the anti-theft trunk lock item now claimed, on the automotive vehicle trunk hood.

The functional concept of assembly of the anti-theft lock product (1') is defined by a first stage, represented in FIG. 19, where the fastening clinch element (Y) is assembled on the body of the universal clench ring element (X), and this assembly occurs by the latch of the rods (Y1) and (Y2) of the fastening clinch element (Y) on the latch structures (X3) and (X4) respectively, by light pressure of the rods on the superficial fissure of said structures, resulting in a click-type latch. The result of this action can be seen in FIG. 20, which indicates the position of the fastening clinch element (Y) immediately prior to activation.

With the execution of said latch of the fastening clinch element (Y) and its correct positioning prior to effective locking of the device, the operator may proceed with the assembly between the universal clench ring (X) and sealing joint (B) elements, on the body of the lock cylinder element (C).

Having completed the first stage, the operator starts the locking per se of the anti-theft lock product (1'), applying a linear dislocation force (Fc), directly on the fastening clinch element (Y), releasing the inflexion area (Y3) of the fastening clinch element (Y) of the latch formed by the wall structures (X7) and high relief area (X8), making the rods (Y1) and (Y2) move in the guides formed in the inner section of the latch structures (X3) (X5) and (X4); (X6) respectively.

Dislocation (Fc) of the fastening clinch element (Y) is up to the limit in which the inflexion segment (Y3) reaches the lowered lock (X9) in the high relief area (X8) so that the device formed by the anti-theft lock (1') is effectively locked to the trunk hood (3), and this condition is verified.

Figure 22:
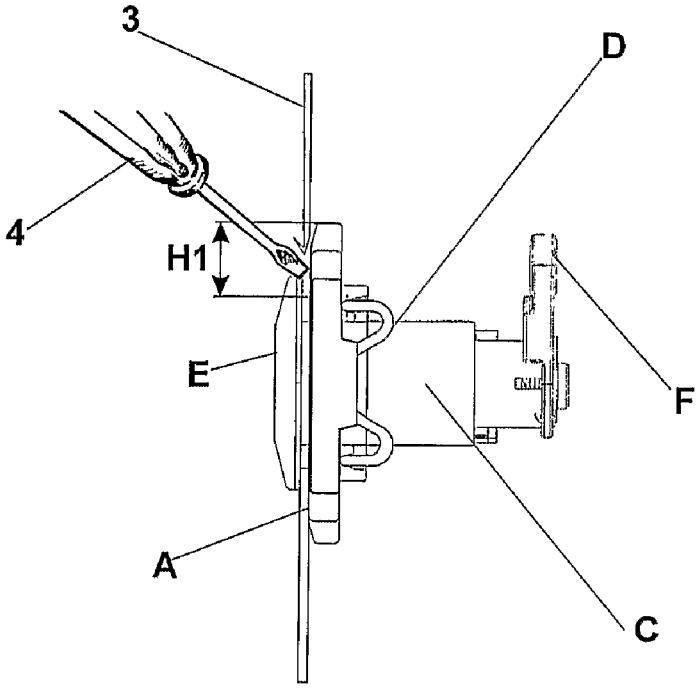
FIG. 22 is a representation of the protection obtained by the bracing element applicable to the anti-theft trunk lock item now claimed.

Concerning the final status, FIG. 22 is a representation of an attempted breakage of the anti-theft lock (1), where the greater outer diameter of the clench ring (A), generates a height barrier (H1), preventing tool access (4) to the bracing element (F), and thus it cannot be undone.

The height (H1) also hinders the total detachment of the anti-theft lock (1), from the latch area provided on the trunk hood (3).

Figure 23:
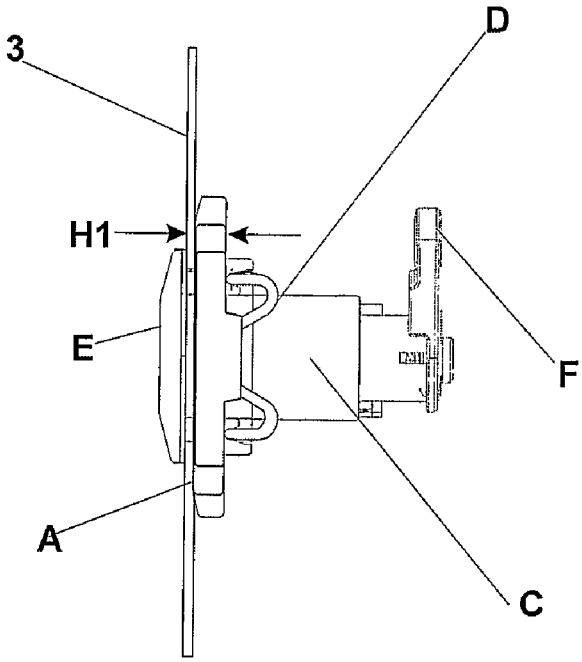
FIG. 23 depicts how to eliminate possible gaps between the anti-theft trunk lock component now claimed and the latch area of the trunk hood.

Finally, FIG. 23 depicts the disposition between the clench ring element (A) and trunk hood (3), generating a width (H2) which eliminates excessive gaps in assembly, thus preventing the anti-theft lock (1) from being moved. Therefore the locking system is not compromised.

Therefore, it can be seen from all that described and illustrated that this constructive improvement to an anti-theft lock device applied to automobile trunks, as it fills an important gap in the automotive sector, particularly because it offers a technical and operational alternative for the trunk lock product, both for a simple setup and for a setup including electric elements in the body of the lock cylinder element (C), and thus is worthy of the respective privilege.

The invention claimed is:

1. An anti-theft lock device comprising:

a clench ring comprising an upper latch, a lower latch, and a relief lock, the clench ring having an outer diameter profile and an inner diameter profile, the clench ring inner diameter profile defining a clench ring hollowed latch area;

a lock cylinder comprising an upper attachment area and a lower attachment area; and a fastening clinch comprising an upper end, a lower end, and an inflexion segment between the upper end and the lower end, the upper end of the fastening clinch adapted for positioning against the lock cylinder upper attachment area, and the lower end of the fastening clinch adapted for positioning against the lock cylinder lower attachment area, wherein the lock cylinder and the positioned fastening clinch are adapted for insertion through the clench ring hollowed latch area, wherein the inflexion segment of the positioned fastening clinch is adapted to pivot toward the clench ring, wherein the upper end of the pivoted fastening clinch is adapted to align with the clench ring upper latch, wherein the lower end of the pivoted fastening clinch is adapted to align with the clench ring lower latch, and wherein the aligned fastening clinch is adapted to slide along the clench ring toward the clench ring relief lock.

2. The anti-theft lock device of claim 1, further comprising a sealing joint having an outer diameter profile and an inner diameter profile, the sealing joint inner diameter profile defining a sealing joint hollowed latch area, wherein the lock cylinder is further adapted for insertion into the sealing joint hollowed latch area.

3. The anti-theft lock device of claim 2, the lock cylinder further comprising an outer section having an outer section profile and an inner section having an inner section profile, the lock cylinder outer section profile generally encompassing the lock cylinder inner section profile, the lock cylinder inner section adapted to pass through the sealing joint hollowed latch area, wherein the lock cylinder inner section profile is substantially identical to the sealing joint inner diameter profile.

4. The anti-theft lock device of claim 3, wherein the clench ring outer diameter profile is substantially identical to the sealing joint outer diameter profile.

5. The anti-theft lock device of claim 3, wherein the clench ring outer diameter profile is larger than the lock cylinder outer section profile.

6. The anti-theft lock device of claim 1, wherein the clench ring outer diameter profile is substantially circular.

7. The anti-theft lock device of claim 1, the clench ring further comprising structural grooves enhancing the stability of the clench ring.

8. The anti-theft lock device of claim 1, wherein the lock cylinder is coupled to an electrical device.

9. A method for constructing an anti-theft lock device, the method comprising:

positioning an upper end of a fastening clinch against an upper attachment area of a lock cylinder;

positioning a lower end of the fastening clinch against a lower attachment area of the lock cylinder;

inserting the lock cylinder and the positioned fastening clinch through a hollowed latch area of a clench ring, wherein the positioned fastening clinch is oriented substantially orthogonal to the clench ring;

applying a radial dislocation force to an inflexion segment of the fastening clinch, the inflexion segment located between the fastening clinch upper end and the fastening clinch lower end, such that the radially dislocated fastening clinch is oriented substantially parallel to the clench ring, the fastening clinch upper end is aligned with an upper latch of the clench ring, and the fastening clinch lower end is aligned with a lower latch of the clench ring; and applying a linear dislocation force to the fastening clinch inflexion segment such that the linearly dislocated fastening clinch inflexion segment is positioned against a relief lock of the clench ring, wherein the clench ring relief lock prevents further dislocation of the fastening clinch.

10. The method of claim 9, wherein the clench ring upper latch is substantially parallel to the clench ring lower latch, and wherein the clench ring hollowed latch area separates the clench ring upper latch and the clench ring lower latch.

11. The method of claim 10, wherein the clench ring relief lock is located substantially midway between the clench ring upper latch and the clench ring lower latch.

12. The method of claim 9, further comprising:

inserting the lock cylinder into a hollowed latch area of a sealing joint, the lock cylinder comprising an outer section and an inner section, wherein only the lock cylinder inner section passes through the sealing joint.

13. The method of claim 9, wherein the lock cylinder has an outer section profile and an inner section profile, wherein the clench ring has an outer diameter profile and an inner diameter profile, and wherein the clench ring outer diameter profile is larger than the lock cylinder outer section profile.

14. The method of claim 9, further comprising:

inserting the lock cylinder into an aperture in an automobile trunk hood before inserting the lock cylinder into the hollowed latch area of the clench ring, wherein a bracing element connected to the lock cylinder is adapted to fasten the automobile trunk hood to the automobile body.

15. An anti-theft lock device comprising:

a clench ring comprising an upper primary latch, a lower primary latch, an upper secondary latch, a lower secondary latch, and a lowered lock, the clench ring having an outer diameter profile and an inner diameter profile, the clench ring inner diameter profile defining a clench ring hollowed latch area;

a lock cylinder comprising an upper attachment area and a lower attachment area, the lock cylinder adapted for insertion into the clench ring hollowed latch area; and a fastening clinch comprising an upper rod, a lower rod, and an inflexion segment between the upper rod and the lower rod, the upper rod of the fastening clinch adapted for positioning within the clench ring upper primary latch, and the lower end of the fastening clinch adapted for positioning within the clench ring lower primary latch, wherein the upper rod of the fastening clinch is further adapted to slide inward out of the clench ring upper primary latch and into the clench ring upper secondary latch, wherein the lower rod of the fastening clinch is further adapted to slide inward out of the clench ring lower primary latch and into the clench ring lower secondary latch, such that the fastening clinch inflexion segment moves inward toward the clench ring lowered lock, wherein the clench ring and the fastening clinch are adapted to be positioned in an interior area relative to a side of a panel, such that no portion of the clench ring and the fastening clinch are adapted to be positioned on an opposite side of the panel.

16. The anti-theft lock device of claim 15, wherein the clench ring outer diameter profile is substantially circular.

17. The anti-theft lock device of claim 15, wherein the clench ring outer diameter profile is substantially circular except for a clench ring support area extending to one side, wherein the clench ring upper primary latch and the clench ring lower primary latch are positioned on the clench ring support area.

18. The anti-theft lock device of claim 17, wherein the clench ring support area comprises a wall and a high-relief area, the wall adapted to prevent outward movement of the positioned fastening clinch, and the high-relief area adapted to stabilize the positioned fastening clinch.

19. The anti-theft lock device of claim 15, further comprising a sealing joint having an outer diameter profile and an inner diameter profile, the sealing joint inner diameter profile defining a sealing joint hollowed latch area, wherein the lock cylinder is further adapted for insertion into the sealing joint hollowed latch area.

20. The anti-theft lock device of claim 15, the lock cylinder further comprising an outer section having an outer section profile and an inner section having an inner section profile, the lock cylinder outer section profile generally encompassing the lock cylinder inner section profile, the lock cylinder inner section adapted to pass through the clench ring hollowed latch area, wherein the clench ring outer diameter profile is larger than the lock cylinder outer section profile.

21. The anti-theft lock device of claim 15, the clench ring further comprising structural grooves enhancing the stability of the clench ring.

22. The anti-theft lock device of claim 15, wherein the fastening clinch upper rod is substantially parallel to the fastening clinch lower rod.

23. The anti-theft lock device of claim 22, wherein the fastening clinch upper rod comprises a rounded end opposite the fastening clinch inflexion segment.

24. The anti-theft lock device of claim 15, wherein the clench ring upper secondary latch is substantially the same length as the fastening clinch upper rod.

25. The anti-theft lock device of claim 24, wherein the fastening clinch upper rod is substantially the same length as the fastening clinch lower rod.

26. A method for constructing an anti-theft lock device, the method comprising:

inserting a lock cylinder into a hollowed latch area of a clench ring, the lock cylinder comprising an outer section and an inner section, wherein only the lock cylinder inner section passes through the clench ring;

positioning an upper rod of a fastening clinch within an upper primary latch of the clench ring;

positioning a lower rod of the fastening clinch within a lower primary latch of the clench ring; and applying an inward linear dislocation force to an inflexion segment of the fastening clinch, the inflexion segment located between the fastening clinch upper rod and the fastening clinch lower rod, such that the fastening clinch upper rod slides away from the clench ring upper primary latch and into the clench ring upper secondary latch and the fastening clinch lower rod slides away from the clench ring lower primary latch and into the clench ring lower secondary latch, and such that the linearly dislocated fastening clinch inflexion segment is positioned against a lowered lock of the clench ring, wherein the clench ring lowered lock prevents further dislocation of the fastening clinch, wherein the clench ring and the fastening clinch are adapted to be positioned in an interior area relative to a side of a panel, such that no portion of the clench ring and the fastening clinch are adapted to be positioned on an opposite side of the panel.

27. The method of claim 26, wherein the clench ring upper secondary latch is substantially parallel to the clench ring lower secondary latch, and wherein the clench ring hollowed latch area separates the clench ring upper secondary latch and the clench ring lower secondary latch.

28. The method of claim 27, wherein the clench ring lowered lock is positioned substantially midway between the clench ring upper secondary latch and the clench ring lower secondary latch.

29. The method of claim 26, wherein positioning the upper rod of the fastening clinch within the upper primary latch of the clench ring comprises pressure fitting the upper rod of the fastening clinch into the upper primary latch of the clench ring, and wherein positioning the lower rod of the fastening clinch within the lower primary latch of the clench ring comprises pressure fitting the lower rod of the fastening clinch into the lower primary latch of the clench ring.

30. The method of claim 26, further comprising:

inserting the lock cylinder into a hollowed latch area of a sealing joint, wherein only the lock cylinder inner section passes through the sealing joint.

31. The method of claim 26, wherein the lock cylinder outer section has an outer section profile and the lock cylinder inner section has an inner section profile, wherein the clench ring has an outer diameter profile and an inner diameter profile, and wherein the clench ring outer diameter profile is larger than the lock cylinder outer section profile.

32. The method of claim 26, further comprising:

inserting the lock cylinder into an aperture in an automobile trunk hood before inserting the lock cylinder into the hollowed latch area of the clench ring, wherein a bracing element connected to the lock cylinder is adapted to fasten the automobile trunk hood to the automobile body.

* * * * *